US005545070A

United States Patent [19]

Liu

[11] Patent Number: 5,545,070

[45] Date of Patent: Aug. 13, 1996

[54] CONSTRUCTION TOY SET OF PLANAR BLOCKS WITH APERTURES AND HINGED CONNECTORS

[76] Inventor: Jin-Su Liu, No. 148, Chien Hsin Rd. Sec. 1, Lin 7, Yuan San Hsiang, Hsin Feng Hsiang, Hsin Chu Hsien, Taiwan

[21] Appl. No.: 436,530

[22] Filed: May 8, 1995

[51] Int. Cl.[6] ..... A63H 33/10; A63H 33/08

[52] U.S. Cl. ..... 446/104; 446/102; 446/115; 446/127; 446/128

[58] Field of Search ..... 446/102, 104, 446/106, 108, 109, 111, 112, 113, 115, 116, 117, 120, 122, 123, 125, 127, 128

[56] References Cited

U.S. PATENT DOCUMENTS

| | | | |
|---|---|---|---|
| 1,245,440 | 11/1917 | Converse | 446/127 |
| 4,704,313 | 11/1987 | Maier | 446/116 X |
| 4,712,336 | 12/1987 | Backer | 446/122 X |
| 4,833,856 | 5/1989 | Zwagerman | 446/122 X |
| 4,874,341 | 10/1989 | Ziegler | 446/104 X |

FOREIGN PATENT DOCUMENTS

| | | | |
|---|---|---|---|
| 1168305 | 4/1964 | Germany | 446/102 |
| 2423417 | 5/1975 | Germany | 446/102 |
| 2155225 | 9/1980 | Germany | 446/102 |
| 586630 | 12/1958 | Italy | 446/128 |
| 2031289 | 4/1980 | United Kingdom | 446/111 |
| 2054393 | 2/1981 | United Kingdom | 446/108 |
| 2087743 | 6/1982 | United Kingdom | 446/102 |

*Primary Examiner*—Robert A. Hafer
*Assistant Examiner*—D. Neal Muir
*Attorney, Agent, or Firm*—Bacon & Thomas

[57] ABSTRACT

A construction toy set of planar blocks with edge apertures and hinged connectors including a plurality of block elements respectively made of flat shape, and a plurality of swivel connectors, each block element having a top side, a bottom side, a plurality of peripheral sides, a plurality of pins at the top side, a plurality of pin holes at the bottom side, a plurality of first retaining grooves equiangularly spaced from one another and respectively disposed in parallel with the peripheral sides, and a plurality of second retaining slots respectively and perpendicularly extended from the first retaining slots to the border, each swivel connector having two reversed base elements turned about an axle, each base element having an axle housing at one end mounted around the axle, a retainer plate at an opposite end for fitting into one first retaining slot, a pin at one side for fitting into one pin hole, and a pin hole at an opposite side for receiving one pin.

10 Claims, 11 Drawing Sheets

CONSTRUCTION TOY SET OF PLANAR BLOCKS WITH APERTURES AND HINGED CONNECTORS

BACKGROUND OF THE INVENTION

The present invention relates to construction toys, and relates more particularly to such a construction toy comprised of a plurality of slotted, polygonal block elements with pins and pin holes for connection with one another, and a plurality of swivel connectors for allowing the block elements to be turned relative to one another.

A variety of construction toys have been disclosed, and have appeared on the market. These construction toys commonly comprise a plurality of block elements having pins and pin holes for connection with one another in limited directions. The commonly drawback of conventional construction toys is that when block elements are connected together, they cannot be turned relative to one another to change the angular position. Therefore, conventional constructional toys provide less variation.

SUMMARY OF THE INVENTION

The present invention provides a construction toy which permits the block elements to be connected with one another in all directions and, which permits the block elements to be turned relative to one another when they are connected with one another by swivel connectors. According to the present invention, the block toy comprises a plurality of block elements respectively made of flat shape, and a plurality of swivel connector, each block element having a top side, a bottom side, a plurality of peripheral sides, a plurality of pins at the top side, a plurality of pin holes at the bottom side, a plurality of first retaining grooves equiangularly spaced from one another and respectively disposed in parallel with the peripheral sides, and a plurality of second retaining slots respectively and perpendicularly extended from the first retaining slots to the border, each swivel connector having two reversed base elements turned about an axle, each base element having an axle housing at one end mounted around the axle, a retainer plate at an opposite end for fitting into one first retaining slot, a pin at one side for fitting into one pin hole, and a pin hole at an opposite side for receiving one pin.

DETAILED DESCRIPTION OF THE PREFERRED EMBODIMENT

Figure 1:
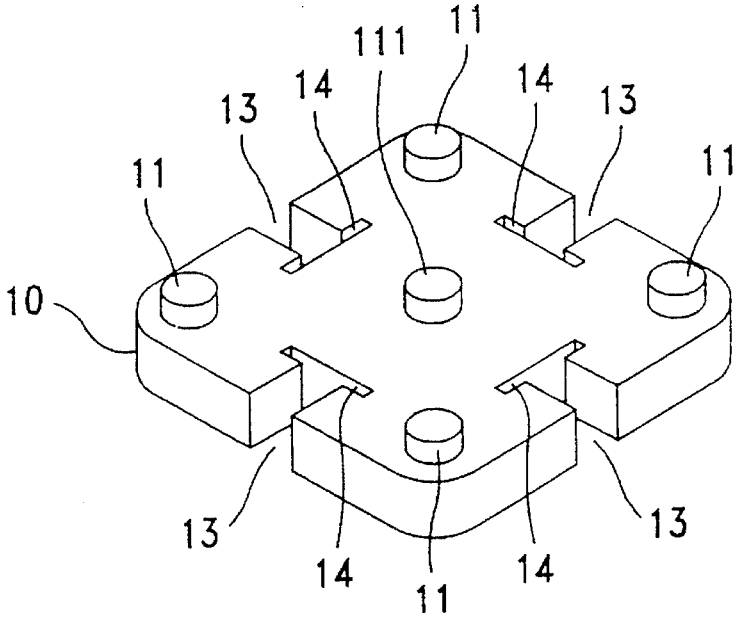
FIG. 1 shows the top side structure of a square block element according to the present invention.
Figure 2:
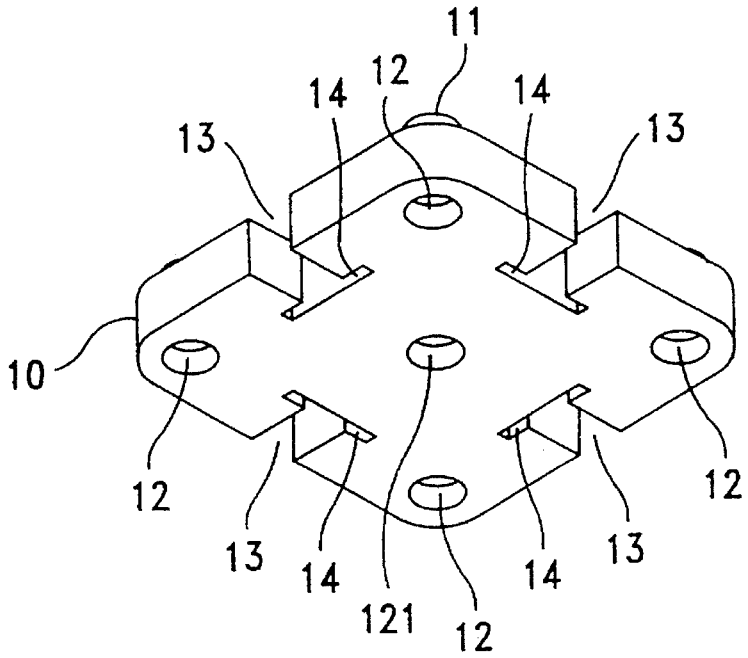
FIG. 2 show the bottom side structure of the square block element shown in FIG. 1.

Referring to FIGS. 1 and 2, the block element, referenced by 10, is made of flat, square shape having a center pin 111 and four corner pins 11 at the top side, a center pin holes 121 and four corner pin holes 12 at the bottom side, four elongated first retaining slots 14 equiangularly spaced around the center of the block element and respectively disposed in parallel with the four peripheral sides, and four second retaining slots 13 respectively and perpendicularly extended from the first retaining slots 14 to the border.

Figure 3:
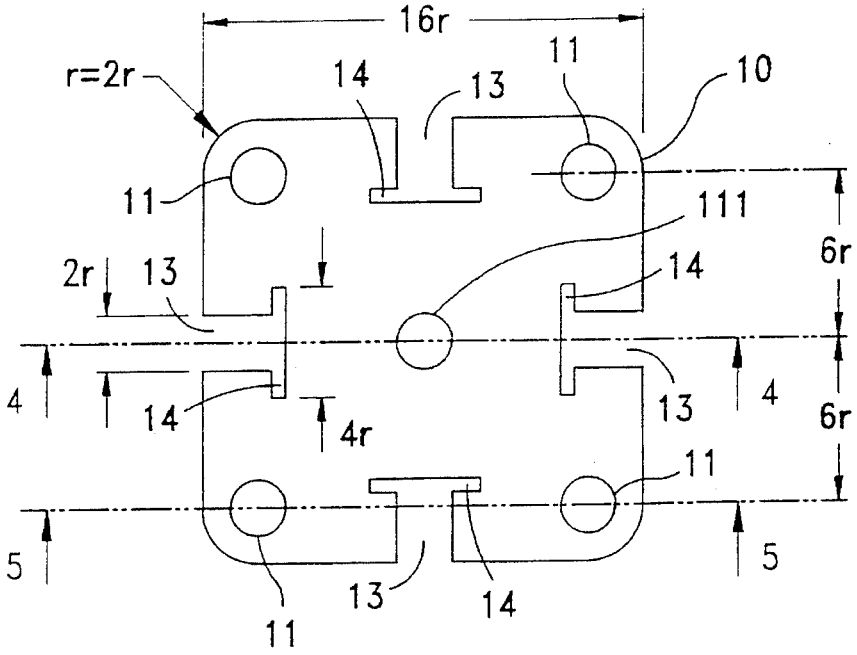
FIG. 3 is a top plain view of the square block shown in FIG. 1.
Figure 4:
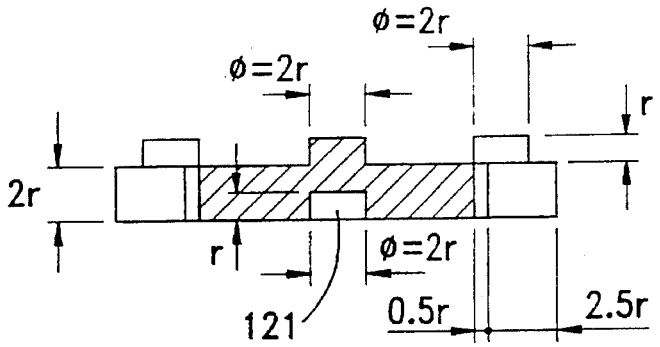
FIG. 4 is a sectional view taken along line 4—4 of FIG. 3.
Figure 5:
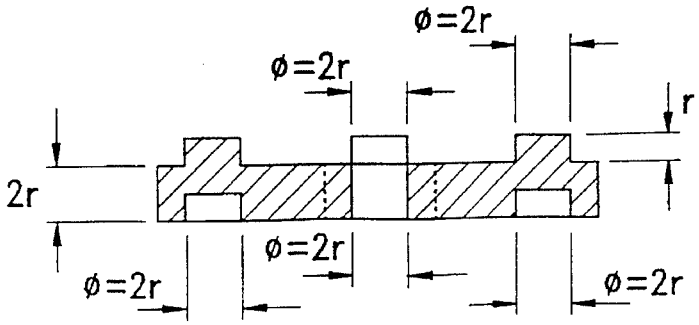
FIG. 5 is a sectional view taken along line 5—5 of FIG. 3.

Referring to FIGS. 3, 4, and 5, when a unit length "r" is used for measuring the size of the square block element 10, the length of each peripheral side is 16r, the thickness is 2 r, the diameter of the pins 11 and 111 is 2 r, the diameter of the pin holes 12 and 121 is 2 r, the height of the pins 11 and 111 is 1 r, the depth of the pin holes 12 and 121 is 1 r, the width of the second retaining slots 13 is 2 r, the depth of the second retaining slots 13 is 2.5 r, the depth of the first retaining slots 14 is 0.5 r, the width of the first retaining slots is 4 r. Furthermore, the four corners of the square block element 10 are circularly chamfered of size 2 r.

Figure 6:
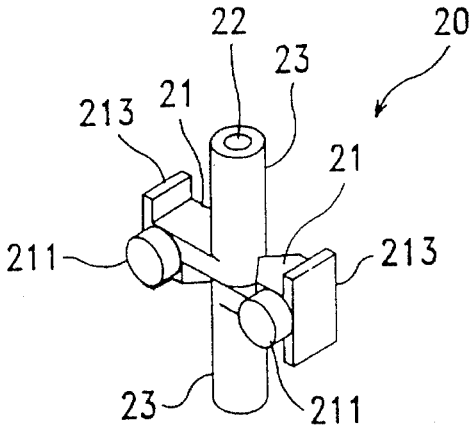
FIG. 6 is an elevational view of a swivel connector according to the present invention.
Figure 7:
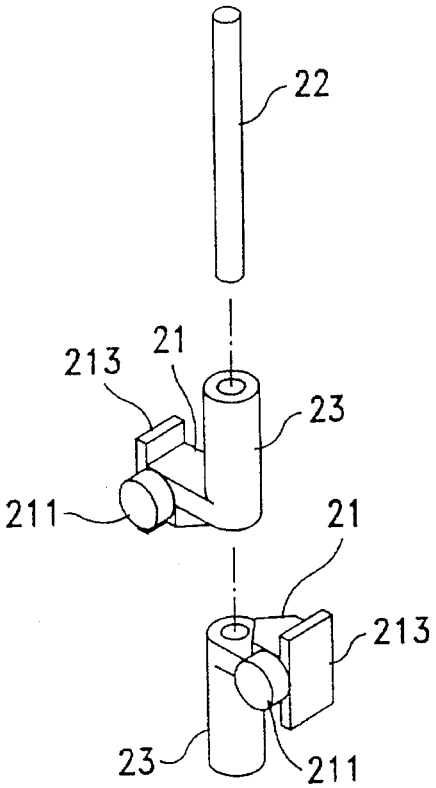
FIG. 7 is an exploded view of the swivel connector shown in FIG. 6.

Referring to FIGS. 6 and 7, the swivel connector, referenced by 20, comprises of two reversed base elements 21 and and an axle 22. The base element 21 fits the second retaining slot 13 in width, having an axle housing 23 at one end, a retainer plate 213 at an opposite end, which fits the first retaining slot 14, a pin 211 at one side, and a pin hole 212 (see FIG. 9) at an opposite side. The size of the pin 211 is equal to that of the pins 11 and 111. The size of the pin hole 212 is equal to that of the pin holes 12 and 121. The axle 22 is inserted into the axle housings 23 of the two reversed base elements 21, permitting the reversed base elements 21 to be respectively turned about the axle 22.

Figure 8:
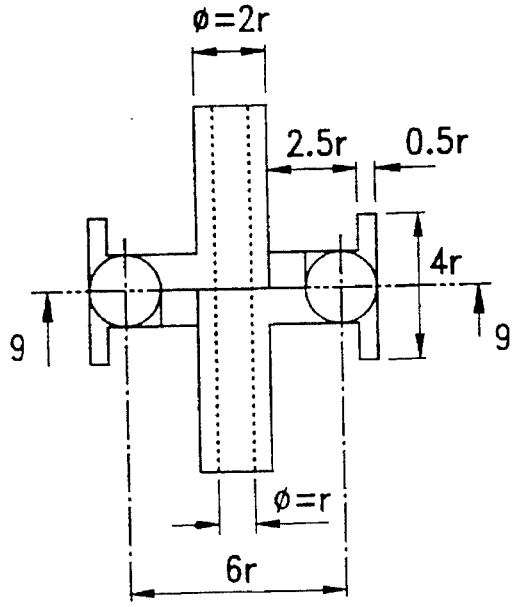
FIG. 8 is a front plain view of the swivel connector shown in FIG. 6.
Figure 9:
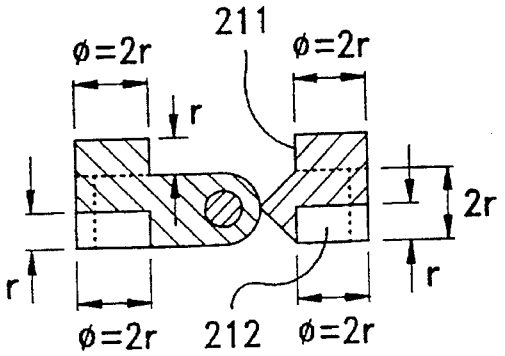
FIG. 9 is a sectional view taken along line 9—9 of FIG. 8.

Referring to FIGS. 8 and 9, when the aforesaid unit length "r" is used for measuring the size of the swivel connector 20, the width of the reversed base elements 21 is 2 r, the length of the reversed base elements 21 is 2.5 r, the thickness of the reversed base elements 21 is 2 r, the width of the retainer plate 213 of each base element 21 is 4 r, the length of the retainer plate 213 is 0.5 r, the thickness of the retainer plate is 2 r, the outer diameter of the axle housing 23 is 2 r, the diameter of the pin 211 is 2 r, the height of the pin is 1 r, the diameter of the pin hole 212 is 2 r, the depth of the pin hole 212 is 1 r, the distance between the pins 211 of the two reversed base elements 21 is 6 r.

According to the aforesaid dimensional statement, the pins 11, 111 and 211 fit the pin holes 12, 121 and 212; the retainer plate 213 fits the first retaining slots 14; the base elements 21 fit the second retaining slots 13; the thickness of the square block element 10 fits the second retaining slots 13.

Figure 10:
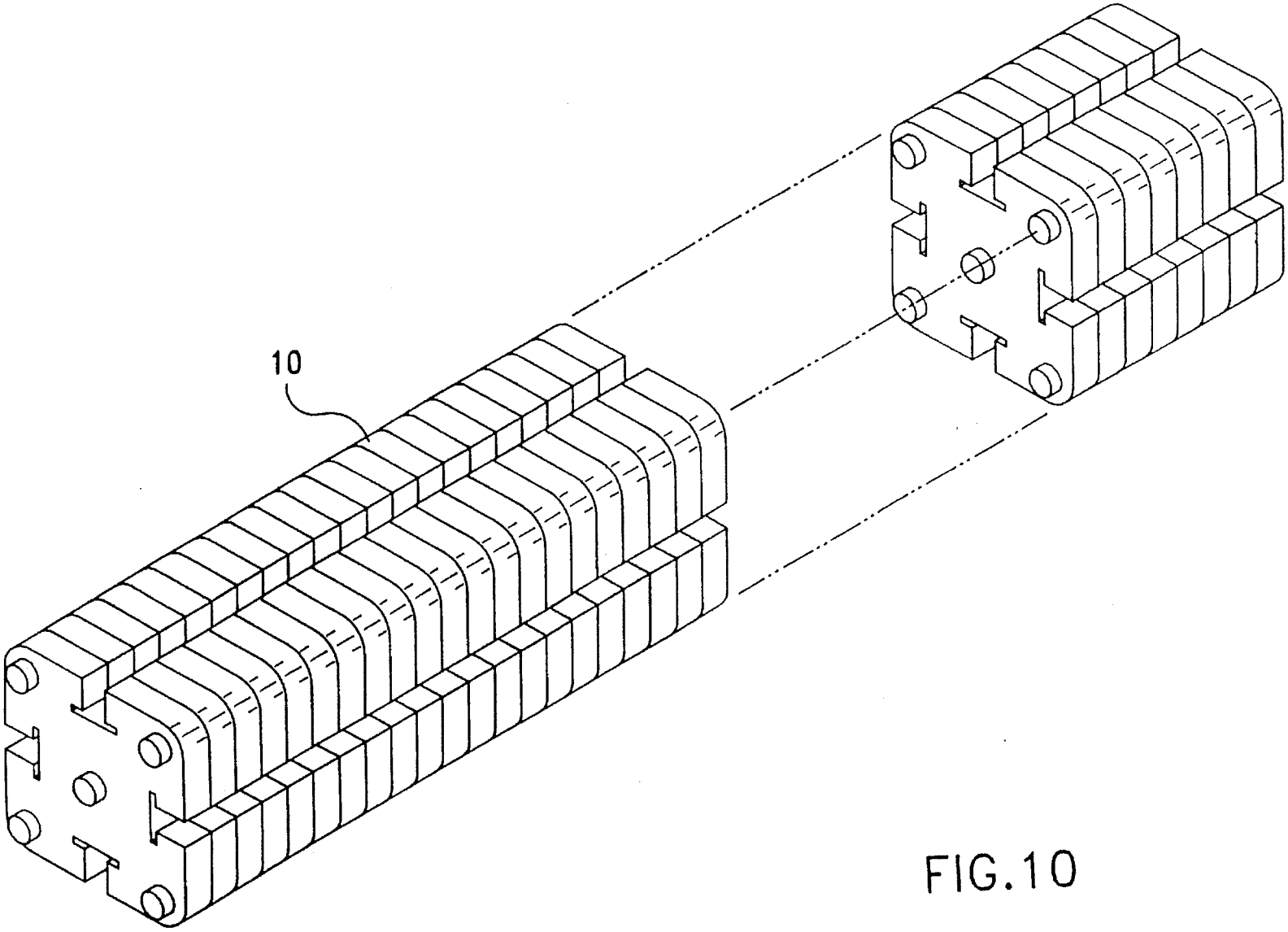
FIG. 10 shows a plurality of square block elements connected in a stack according to the present invention.

Referring to FIG. 10, by fitting the pins 11 and 111 of one square block element 10 into the pin holes 12 and 121 of another, a plurality of square block elements 10 are connected in a stack.

Figure 11:
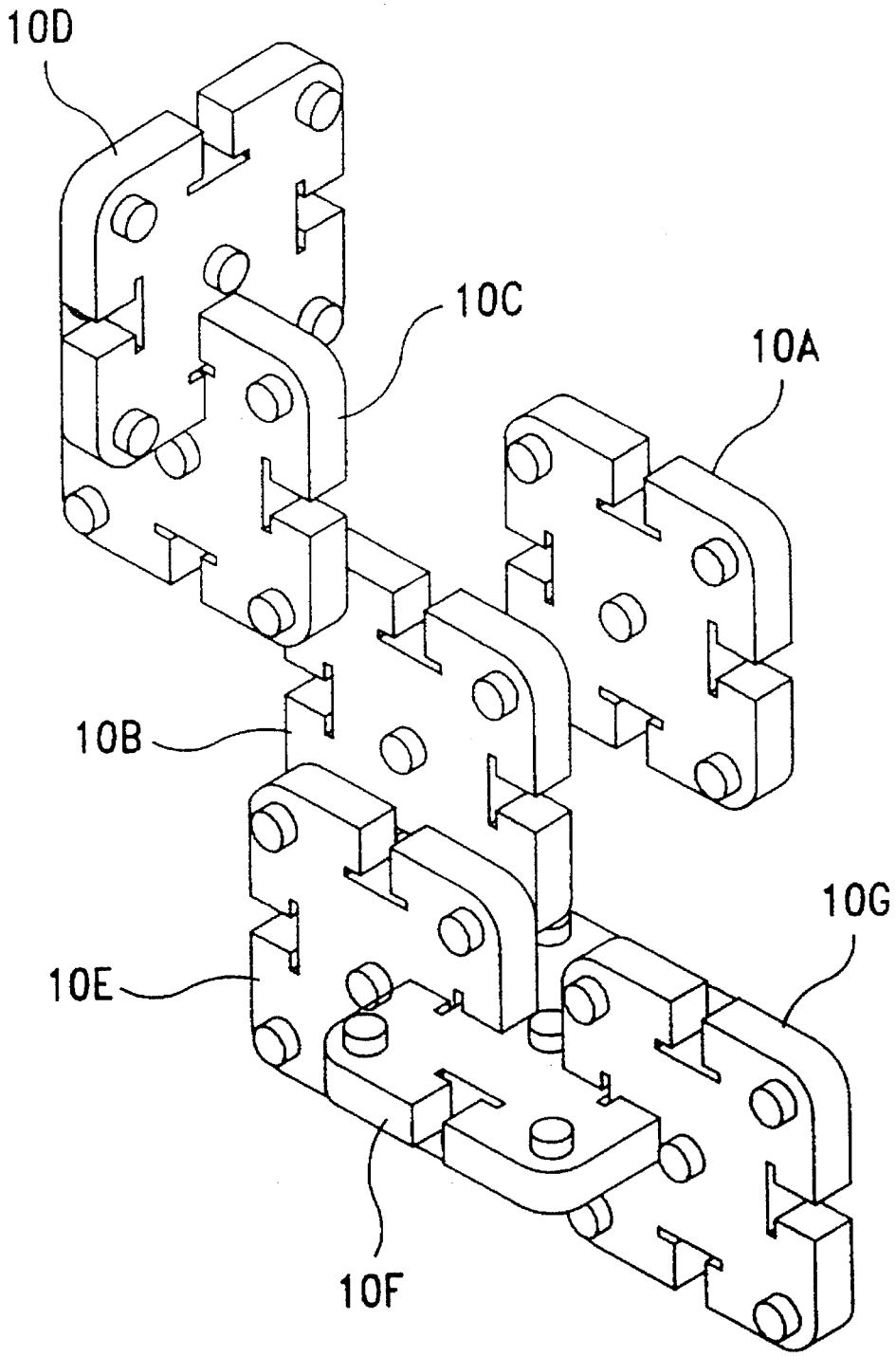
FIG. 11 shows a plurality of square block elements connected with one another in different directions according to the present invention.

FIG. 11 shows a plurality of square block elements connected with one another in different directions. As illustrated, the square block element 10A is connected to the upper right corner of the square block element 10B, the square block element 10C is connected to the upper left corner of the square block element 10B, the square block element 10D is perpendicularly connected to the square block element 10C at the top, the square block element 10E connected to the square block 10B at the bottom and overlapped on a part of the square block element 10B, the square block element 10G is connected to the square block element 10E by the square block element 10F, the square block element 10F is perpendicularly connected between the square block element 10E and the square block element 10G.

Figure 12:
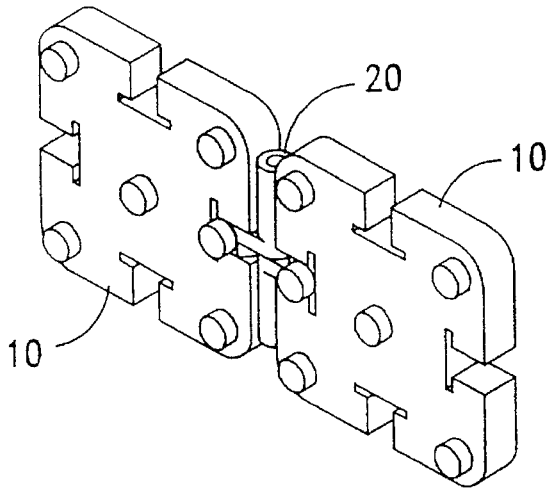
FIG. 12 shows two square block elements connected together by a swivel connector according to the present invention.
Figure 13:
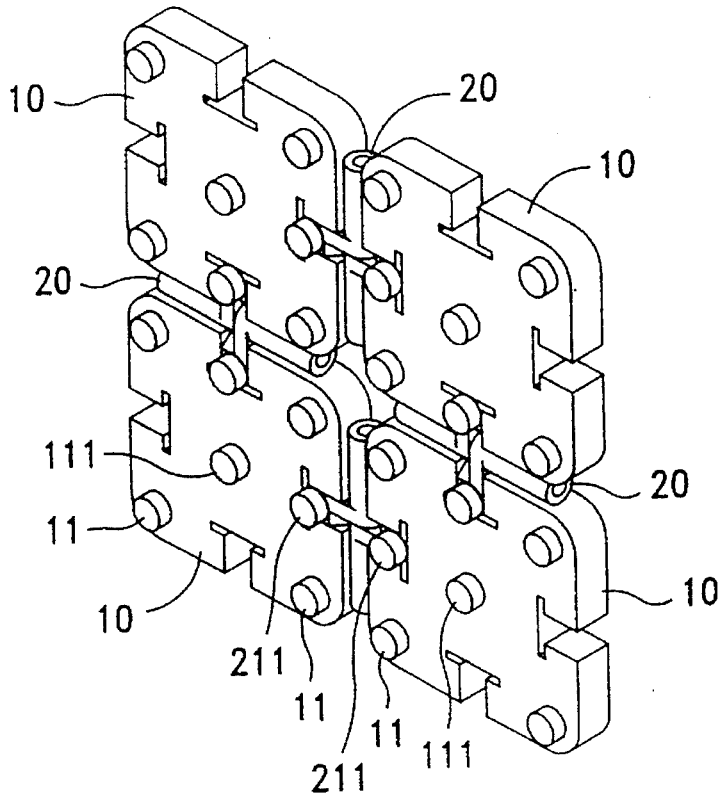
FIG. 13 shows four square block elements connected with one another on the same plane by respective swivel connectors according to the present invention.
Figure 13A:
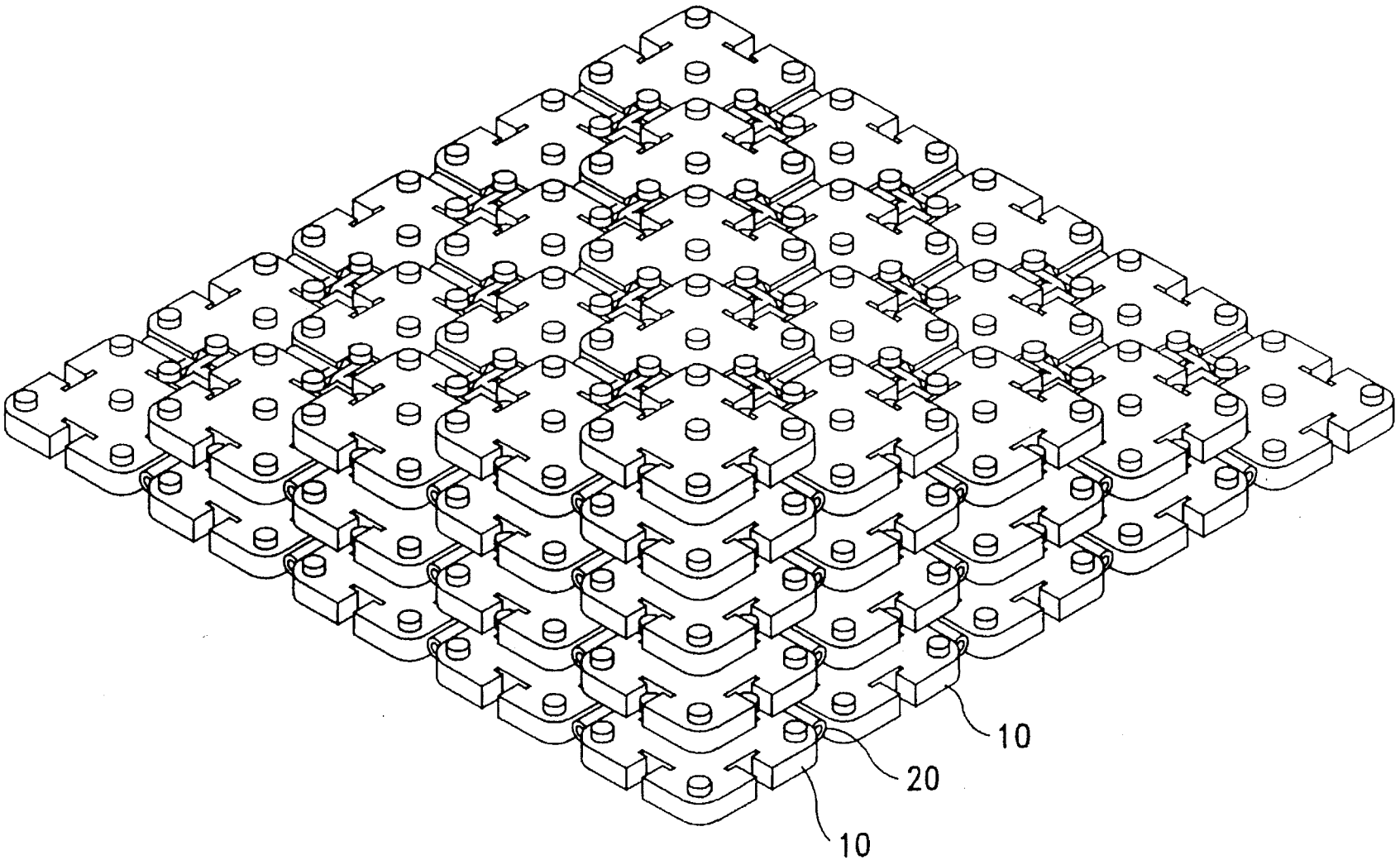
FIG. 13A shows a plurality of square block elements connected with one another at different elements by swivel connectors according to the present invention.
Figure 14:
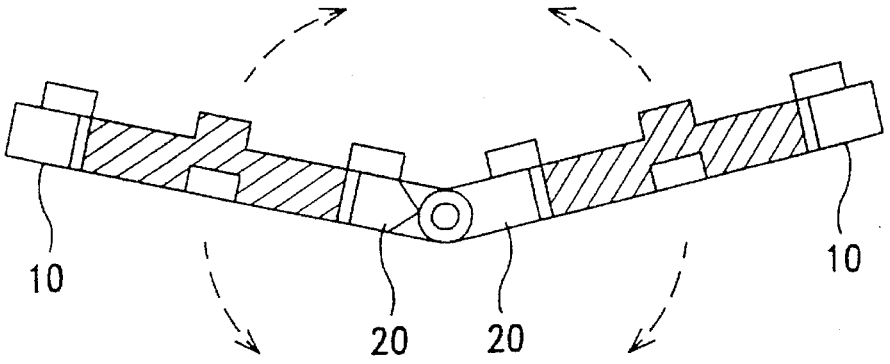
FIG. 14 shows two square block elements connected together by a swivel connector and turned relative to each other according to the present invention.
Figure 15:
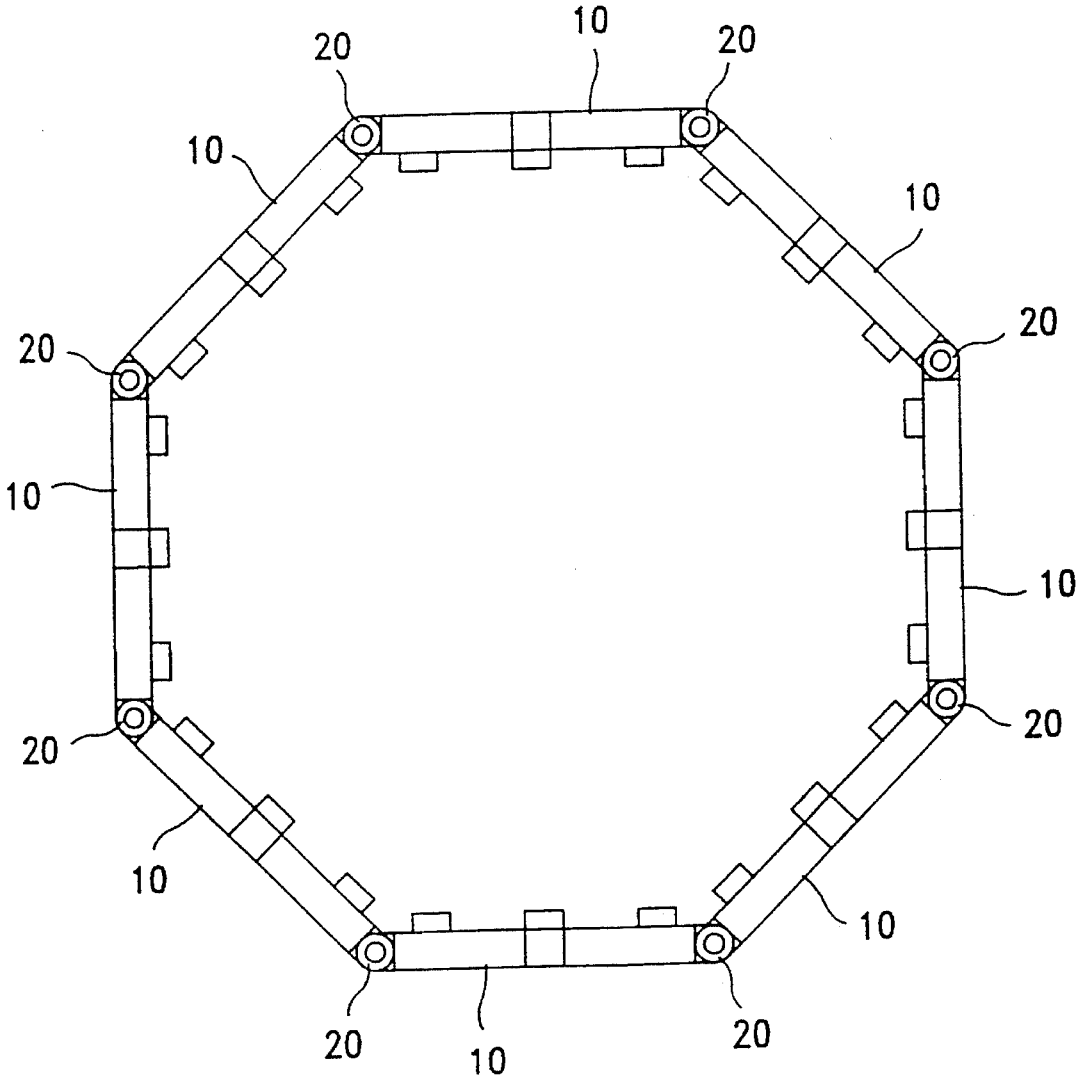
FIG. 15 shows a plurality of square block elements connected with one another by swivel connectors into the form of a polygonal configuration according to the present invention.

Referring to Figures from 12 to 15, as indicated, the pins 11, 111 and 211 fit the pin holes 12, 121 and 212, the retainer plate 213 fits the first retaining slots 14, the base elements 21 fit the second retaining slots 13, and the thickness of the square block element 10 fits the second retaining slots 13. Therefore, a plurality of square block elements 10 can be connected into any of a variety of forms. For example, two square block elements 10 can be connected together by a swivel connector 20, as shown in FIG. 12; four square block elements 10 can be connected with one another on the same plane by swivel connectors 20, as shown in FIG. 13; a plurality of square block elements 10 can be connected together at different elevations by swivel connectors 20, as shown in FIG. 13A; two square block elements 10 can be hinged by one swivel block 20 and turned relative to each other, as shown in FIG. 14; a plurality of square block elements 10 can be connected with one another by swivel connectors 20 into the form of a polygonal configuration, as shown in FIG. 15.

Figure 16:
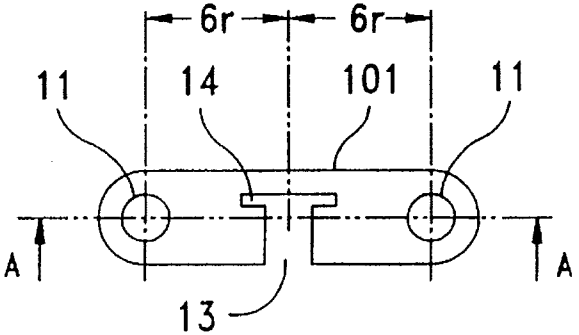
FIG. 16 shows a rectangular block element according to the present invention.
Figure 16A:
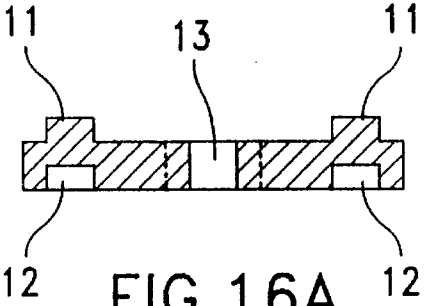
FIG. 16A is a sectional view taken along line A—A of FIG. 16.

Referring to FIGS. 16 and 16A, the block element, referenced by 11, is made of rectangular shape having two pins 11 at one side near the two opposite ends, two pin holes 12 at an opposite side corresponding to the pins 11, an elongated first retaining slot 14 longitudinally disposed in the middle, and a second retaining slot 13 perpendicularly extended from the first retaining slot 14 to the border.

Figure 17:
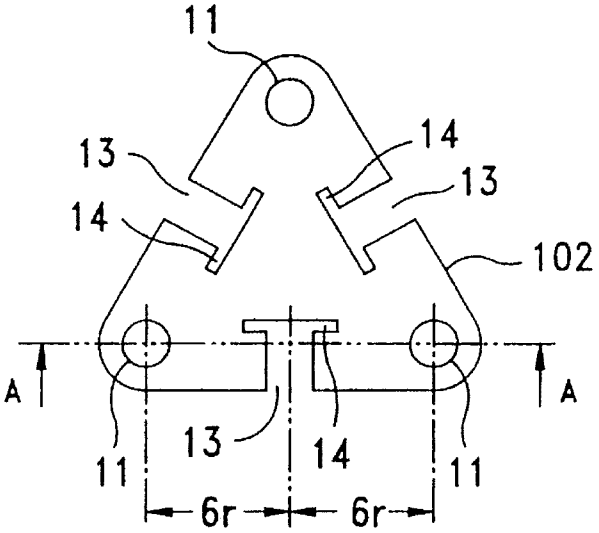
FIG. 17 shows a triangular block element according to the present invention.
Figure 17A:
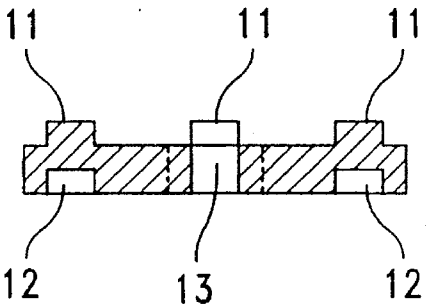
FIG. 17A is a sectional view taken along line A—A of FIG. 17.

Referring to FIGS. 17 and 17A, the block element, referenced by 102, is made of triangular shape having three pins 11 at one side in the three angles, three pin holes 12 at an opposite side corresponding to the pins 11, three elongated first retaining slots 14 respectively disposed in parallel with the three peripheral sides, and three second retaining slots 13 respectively and perpendicularly extended from the first retaining slots 14 to the border.

Figure 18:
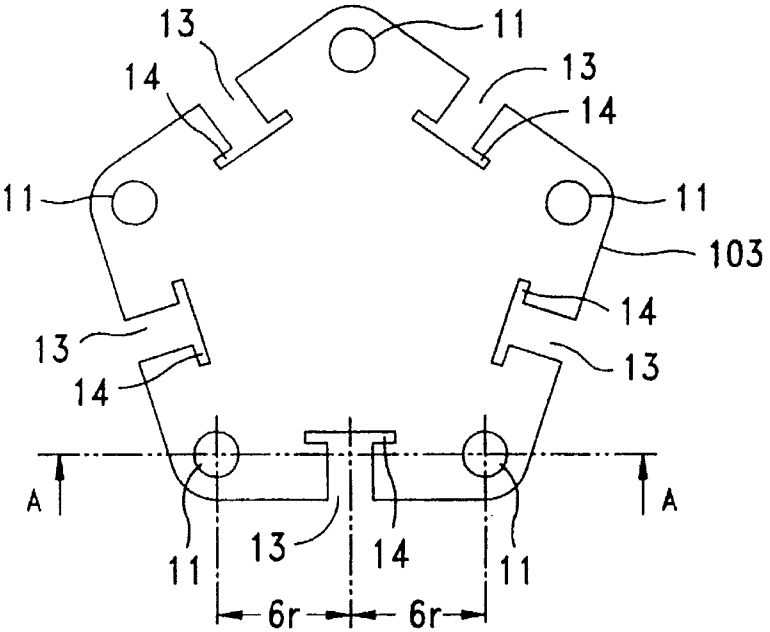
FIG. 18 shows a pentagonal block element according to the present invention.
Figure 18A:
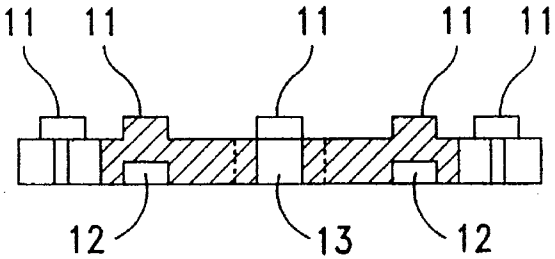
FIG. 18A is a sectional view taken along line A—A of FIG. 18.

Referring to FIGS. 18 and 18A, the block element, referenced by 103, is made of pentagonal shape having five pins 11 at one side in the five angles, five pin holes 12 at an opposite side corresponding to the pins 11, five elongated first retaining slots 14 respectively disposed in parallel with the five peripheral sides, and five second retaining slots 13 respectively and perpendicularly extended from the first retaining slots 14 to the border.

Figure 19:
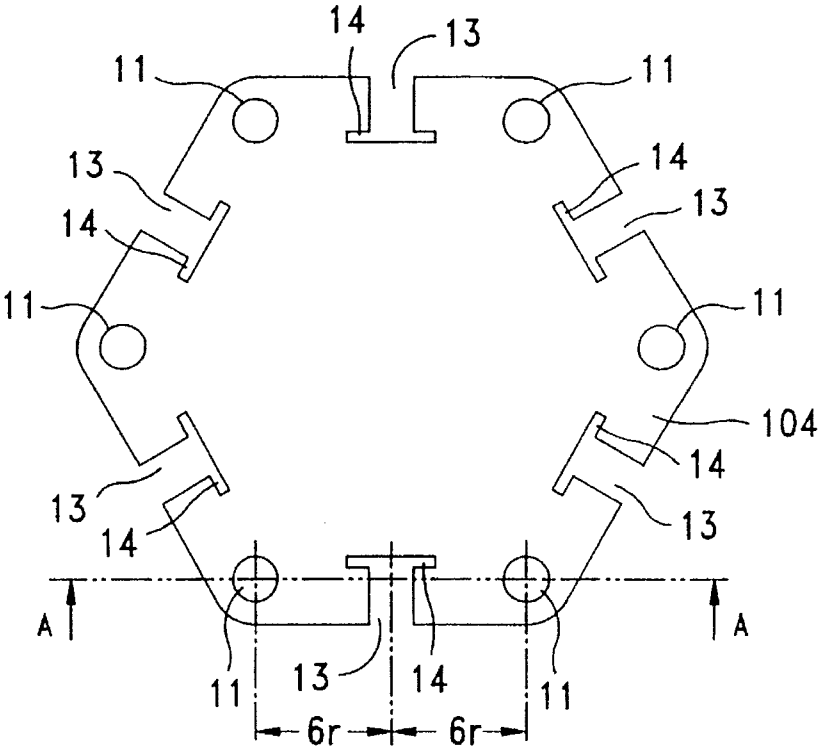
FIG. 19 is a hexagonal block element according to the present invention.
Figure 19A:
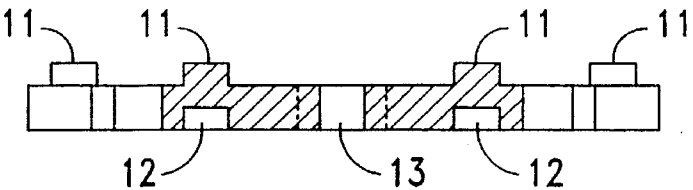
FIG. 19A is a sectional view taken along line A—A of FIG. 19.

Referring to FIGS. 19 and 19A, the block element, referenced by 104, is made of hexagonal shape having six pins 11 at one side in the six angles, six pin holes 12 at an opposite side corresponding to the pins 11, six elongated first retaining slots 14 respectively disposed in parallel with the six peripheral sides, and six second retaining slots 13 respectively and perpendicularly extended from the first retaining slots 14 to the border.

Figure 20:
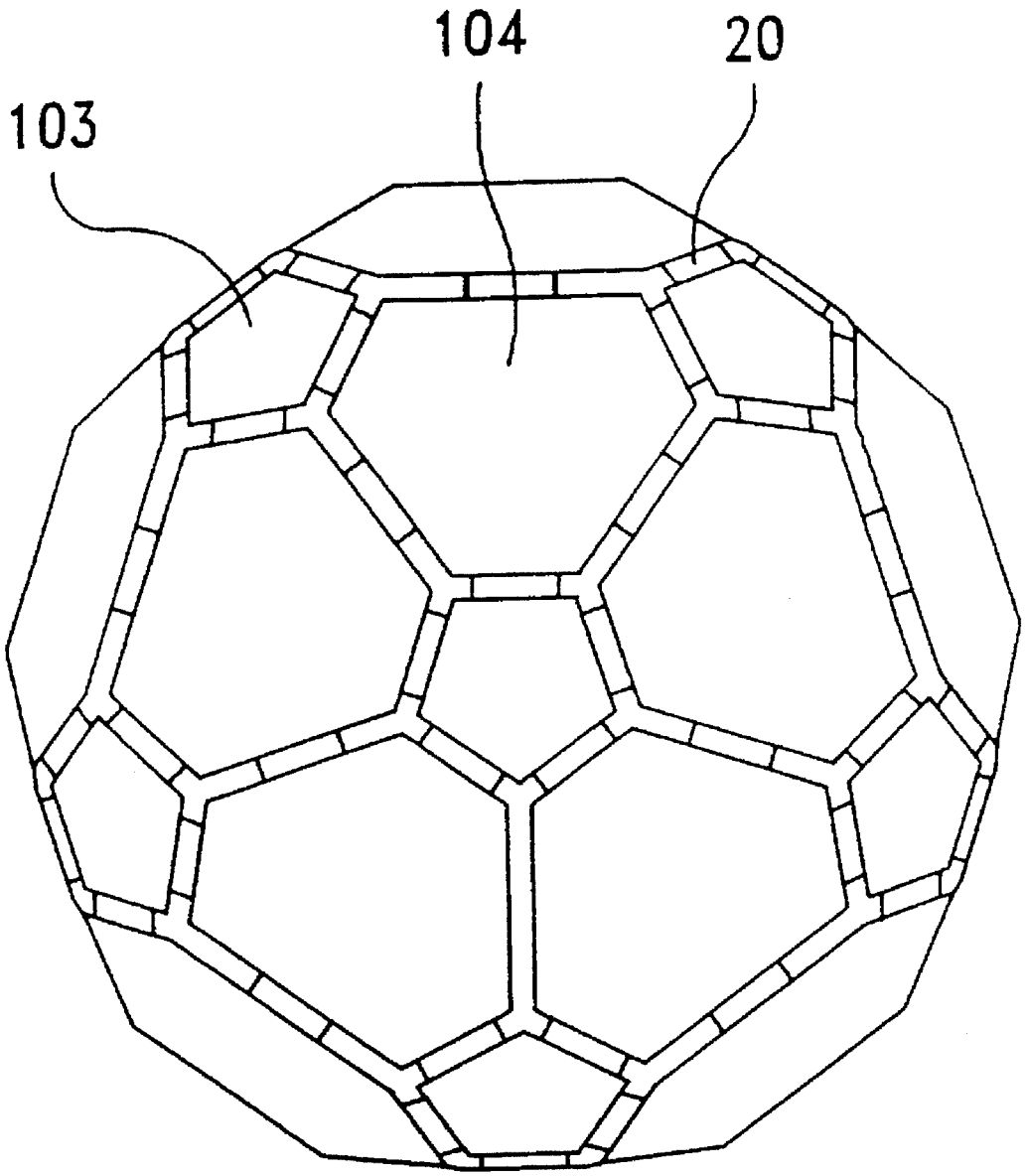
FIG. 20 shows a plurality of pentagonal block elements and hexagonal block elements connected with one another by swivel connectors according to the present invention.

Referring to FIG. 20, a plurality of pentagonal block elements 103 and hexagonal block elements 104 can be connected with one another by swivel connectors 20 into the configuration of a soccer ball.

It is to be understood that the drawings are designed for purposes of illustration only, and are not intended as a definition of the limits and scope of the invention disclosed.

I claim:

1. A construction toy set of planar blocks with edge apertures and hinged connectors comprising a plurality of block elements for connection with one another, and a plurality of swivel connectors for connecting said block elements together for allowing them to be turned relative to one another, wherein:

each block element is made of a flat shape having a top side, a bottom side, and a plurality of peripheral sides, comprising a plurality of pins at the top side, a plurality of pin holes at the bottom side corresponding to said pins, a plurality of first retaining grooves equiangularly spaced from one another and respectively disposed in parallel with the peripheral sides, and a plurality of second retaining slots respectively and perpendicularly extended from said first retaining slots to said peripheral sides, the pins on one flat block element being for fitting into the pin holes on another flat block element for allowing said flat blocks to be connected with one another;

said swivel connectors each comprises two reversed based elements and an axle, each base element being approximately equal to said second retaining slots in width, having an axle housing at one end mounted around said axle, a retainer plate at an opposite end for fitting into one first retaining slot on one block element, a pin at one side for fitting into one pin hole on one block element, and a pin hole at an opposite side for receiving one pin of one block element or one pin of another swivel connector.

2. The construction toy set of planar blocks with edge apertures and hinged connectors of claim 1 wherein each of said flat block elements is made of a a rectangular shape, each comprising two pins at one side near two opposite ends, two pin holes locating on the bottom side corresponding to the locations of the opposing pins, an elongated first retaining slot longitudinally disposed in a middle position, and a second retaining slot perpendicularly extended from the first retaining slot to said peripheral side.

3. The construction toy set of planar blocks with edge apertures and hinged connectors of claim 1 wherein each of said flat block elements is made of a triangular shape having a top side, a bottom side, and three peripheral sides, each comprising three pins at the top side in the three angles, three pin holes at the bottom side corresponding to the pins, three elongated first retaining slots equiangularly spaced from one another and respectively disposed in parallel with the three peripheral sides, and three second retaining slots respectively and perpendicularly extended from the first retaining slots to said peripheral sides.

4. The construction toy set of planar blocks with edge apertures and hinged connectors of claim 3 wherein each triangular block element further comprises a fourth pin disposed at a center of the top side and a fourth pin hole disposed at a center of the bottom side.

5. The construction toy set of planar blocks with edge apertures and hinged connectors wherein each of said flat block elements is made of a square shape having a top side, a bottom side, and four peripheral sides, each square block element comprising four pins respectively disposed in four corners, four pin holes at the bottom side corresponding to the pins, four first retaining slots equiangularly spaced from one another and respectively disposed in parallel with the four peripheral sides, and four second retaining slots respectively and perpendicularly extended from the first retaining slots to said peripheral sides.

6. The construction toy set of planar blocks with edge apertures and hinged connectors of claim 5 wherein each square block element further comprises a fifth pin at a center of the top side, and a fifth pin hole at a center of the bottom side.

7. The construction toy set of planar blocks with edge apertures and hinged connectors of claim 1 wherein each of said flat block elements is made of a pentagonal shape having a top side, a bottom side, and five peripheral sides, each pentagonal block element comprising five pins at the top side in five angles, five pin holes at the bottom side corresponding to the pins, five elongated first retaining slots respectively disposed in parallel with the five peripheral sides, and five second retaining slots respectively and perpendicularly extended from the first retaining slots to said peripheral sides.

8. The construction toy set of planar blocks with edge apertures and hinged connectors of claim 7 wherein each pentagonal block element further comprises a sixth pin at a center of the top side, and a sixth pin hole at a center of the bottom side.

9. The construction toy set of planar blocks with edge apertures and hinged connectors of claim 1 wherein each of said flat block elements is made of a hexagonal shape having a top side, a bottom side, and six peripheral sides, each hexagonal block element comprising six pins at the top side in six angles, six pin holes at the bottom side corresponding to the pins, six elongated first retaining slots respectively disposed in parallel with the six peripheral sides, and six second retaining slots respectively and perpendicularly extended from the first retaining slots to said peripheral sides.

10. The construction toy set of planar blocks with edge apertures and hinged connectors of claim 9 wherein each hexagonal block element further comprises a seventh pin at a center of the top side, and a seventh pin hole at a center of the bottom side.

* * * * *